US005762275A

United States Patent [19]

Aikawa

[11] Patent Number: 5,762,275

[45] Date of Patent: Jun. 9, 1998

[54] DOUBLE-DISC REFINER

[75] Inventor: Yoshihiko Aikawa, Shizuoka, Japan

[73] Assignee: Aikawa Iron Works Co., Ltd., Shizuoka, Japan

[21] Appl. No.: 742,823

[22] Filed: Oct. 31, 1996

[30] Foreign Application Priority Data

Sep. 24, 1996 [JP] Japan ..... 8-251732

[51] Int. Cl.[6] ..... B02C 7/11

[52] U.S. Cl. ..... 241/261.2; 241/297

[58] Field of Search ..... 241/261.2, 261.3, 241/296, 297, 298

[56] References Cited

U.S. PATENT DOCUMENTS 3,214,104 10/1965 Breuninger ..... 241/297

FOREIGN PATENT DOCUMENTS 61-39198 3/1986 Japan .

2026897 2/1980 United Kingdom ..... 241/297

OTHER PUBLICATIONS

Sprout Waldron Pressurized Refiner Oct. 1959.

*Primary Examiner*—Mark Rosenbaum

*Attorney, Agent, or Firm*—Kanesaka & Takeuchi

[57] ABSTRACT

A double-disc refiner of the invention is formed of a driving shaft having one free end, a rotating disc fixed on the driving shaft and having a first rotating blade provided on one surface and a second rotating blade provided on the other surface thereof, and a crushing chamber surrounding the rotating disc, and first and second a material supply passages. On an inner wall of the crushing chamber, a first stationary blade is disposed to face the first rotating blade, and a second stationary blade is disposed to face the second rotating blade. An end surface of the one free end of the driving shaft is located in the first paper material supply passage, and includes projections to closely face a portion of the first paper material passage to prevent the material flowing through the first material supply passage from entering between the portion and the projections. Therefore, on the end surface of the driving shaft, pressure caused by the material is reduced to equalize spaces between the respective rotating and stationary blades.

8 Claims, 7 Drawing Sheets

DOUBLE-DISC REFINER

BACKGROUND OF THE INVENTION AND RELATED ART STATEMENT

The present invention relates to a double-disc refiner for crushing a material in a material solution, such as suspension of a paper material for paper-making, and particularly to a double-disc refiner, wherein one end surface of a driving shaft is located in an inflow side of a crushing chamber. More specifically, the prevent invention relates to a double-disc refiner, wherein a pressure applied to the end surface of the driving shaft is decreased to reduce the effect of the pressure applied to the driving shaft, and the driving shaft is moved or shifted by the pressures applied to both surfaces of a rotating disc so as to equalize spaces between rotating blades and stationary blades.

A conventional double-disc refiner in which an end surface of a driving shaft is located in an inflow side of a crushing chamber has been known, for example, in Japanese Utility Model Publication (KOKAI) 61-39198 (especially FIG. 1).

In the double-disc refiner described in the aforementioned publication, a driving shaft is moved or shifted by pressures applied to both surfaces of a rotating disc to equalize respective spaces between a rotating blade and a stationary blade.

However, since an end surface of the driving shaft is located in the inflow side of the crushing chamber, the end surface of the driving shaft is pushed by the paper material flowing into the crushing chamber in addition to the pressures applied to both surfaces of the rotating discs, so that the respective spaces between the rotating blade and stationary blade are not equalized. Therefore, it has been a problem that the paper material can not be equally crushed.

Accordingly, the present invention has been made to solve the foregoing problems, and it is an object of the present invention to provide a double-disc refiner, wherein a pressure applied to an end surface of a driving shaft by a material supplying to the refiner is minimized.

Another object of the invention is to provide a double-disc refiner as stated above, wherein the material supplied to the refiner can be equally crushed.

A further object of the invention is to provide a double-disc refiner as stated above, wherein the pressure applied to the end surface can be easily reduced.

Further objects and advantages of the invention will be apparent from the following description of the invention.

SUMMARY OF THE INVENTION

To achieve the above objects, the present invention provides a double-disc refiner comprising: a driving shaft having a free end and a supported end and being movable in a shaft direction; a rotating disc fixed near the free end of the driving shaft; a first rotating blade attached to one surface of the rotating disc; a second rotating blade attached to the other surface of the rotating disc; a crushing chamber for crushing a paper material disposed to surround the rotating disc; a first stationary blade disposed on an inner wall of the crushing chamber to face the first rotating blade; and a second stationary blade disposed on the inner wall of the crushing chamber to face the second rotating blade.

The crushing chamber is formed of a first crushing chamber for crushing a paper material located between the first rotating blade and the first stationary blade; a second crushing chamber for crushing a paper material located between the second rotating blade and the second stationary blade; a first paper material supply passage for supplying the paper material from an outside of the crushing chambers into the first crushing chamber; a second paper material supply passage for supplying the paper material from the outside of the crushing chambers into the second crushing chamber; a communicating chamber for combining the paper material crushed in the first and second crushing chambers; and a discharge port for discharging the crushed paper materials from the communicating chamber to the outside of the crushing chambers.

An end surface of the one free end of the driving shaft is located in the first paper material supply passage. A portion of the first paper material supply passage is located adjacent to the end surface of the driving shaft, and the end surface is provided with projections for preventing the paper material flowing through the first paper material supply passage from entering between the end surface and the portion of the first paper material supply passage.

Alternatively, instead of forming the portion of the first paper material supply passage near the end surface of the driving shaft, the projections for preventing the paper material may be formed on the end surface of the driving shaft near the portion of the first paper material supply passage without contacting thereto.

DETAILED DESCRIPTION OF PREFERRED EMBODIMENTS

Figure 1:
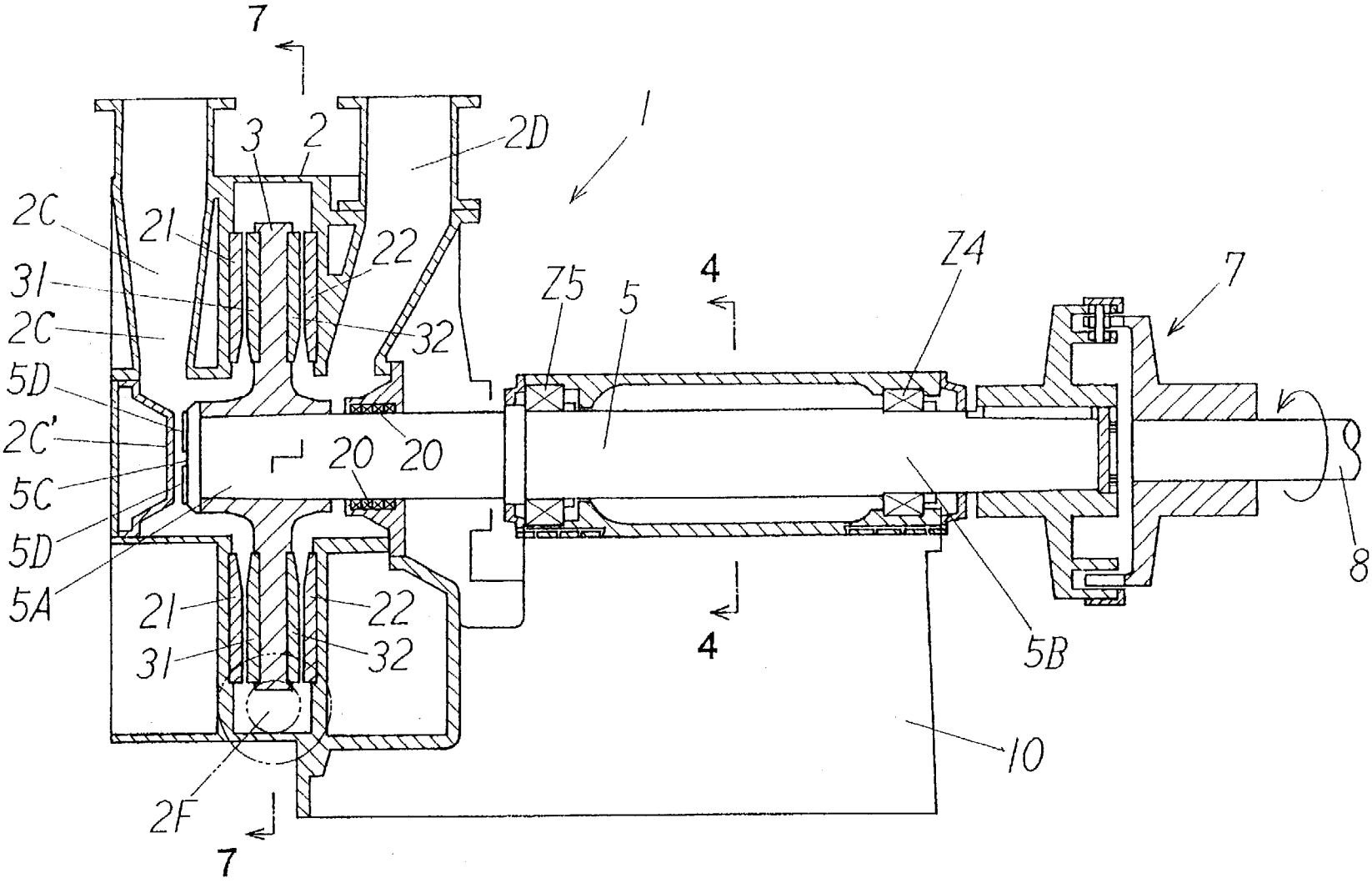
FIG. 1 is a schematic sectional view for showing a double-disc refiner of an embodiment according to the present invention.
Figure 2:
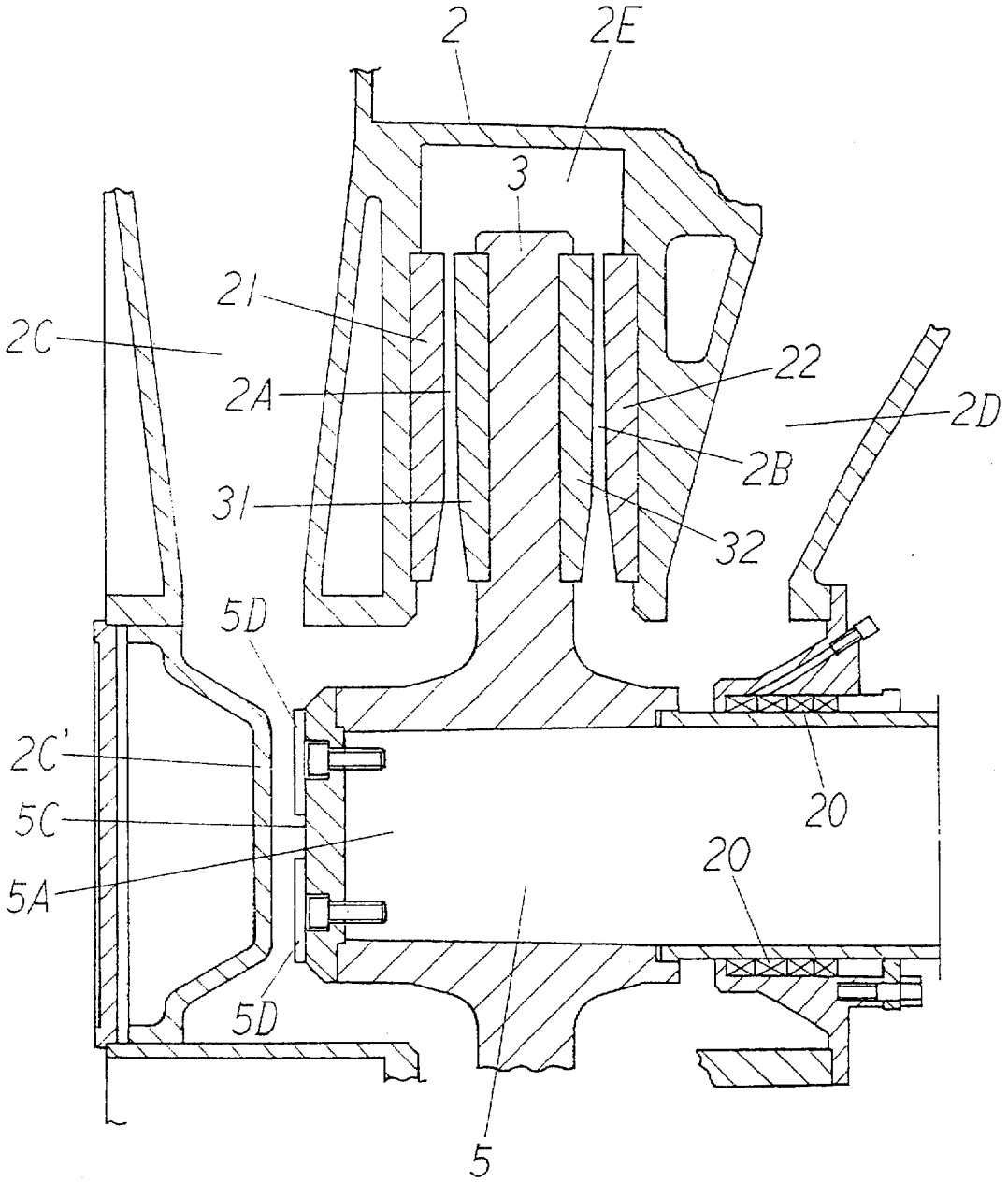
FIG. 2 is a schematic enlarged sectional view for showing a crushing chamber shown in FIG. 1.
Figure 3:
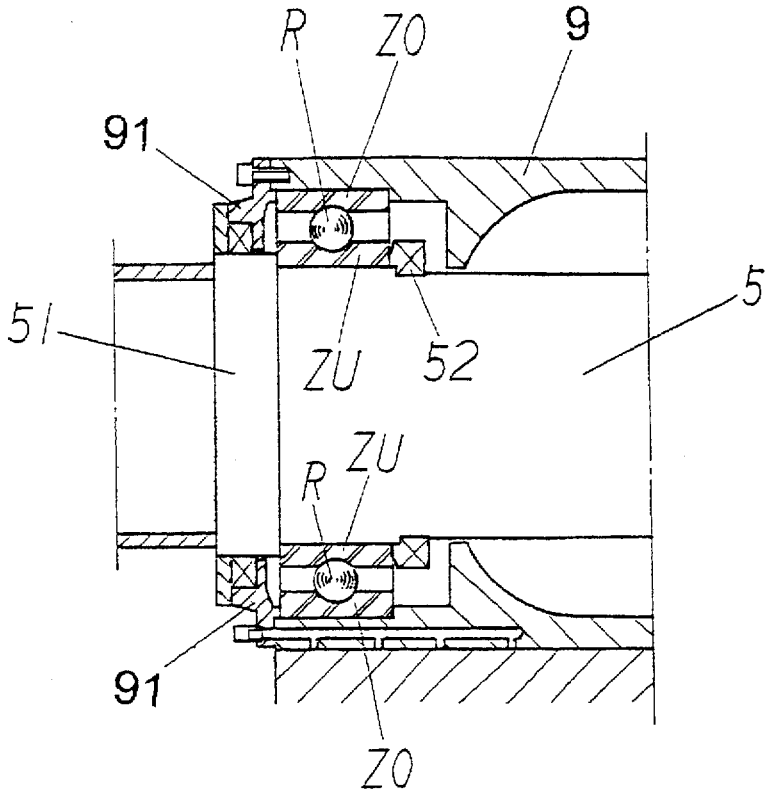
FIG. 3 is a schematic enlarged sectional view for showing a driving shaft shown in FIG. 1.

A double-disc refiner of an embodiment according to the present invention is explained with reference to the drawings hereinafter.

Numeral 1 designates a double-disc refiner for crushing a paper material in a paper material solution, such as suspension of a paper material for paper-making, and the double-disc refiner 1 includes a rotating disc 3 inside a crushing chamber 2; a first rotating blade 31 attached to one surface of the rotating disc 3; a second rotating blade 32 attached to the other surface of the rotating disc 3; a first stationary blade 21 provided on an inner wall of the crushing chamber 2 to face the first rotating blade 31; and a second stationary blade 22 provided on the inner wall of the crushing chamber 2 to face the second rotating blade 32.

The first rotating blade 31 is, for example, formed of a plurality of divided rotating blade elements in a fan shape having projections and grooves and attached to the one surface of the rotating disc 3 by bolts or the like (not shown). Similarly, the second rotating blade 32 is, for example, formed of a plurality of divided rotating blade elements in a fan shape having projections and grooves and attached to the other surface of the rotating disc 3 by bolts B or the like.

The rotating disc 3 is attached to a driving shaft 5. The driving shaft 5 is disposed such that one side 5A thereof is not supported to become free, and the other side 5B thereof is supported. The driving shaft 5 is movable in the direction of the shaft.

The crushing chamber 2 is disposed to cover or surround the rotating disc 3, and comprises: a first crushing chamber 2A in which the paper material is crushed and the first rotating blade 31 and the first stationary blade 21 face each other; a second crushing chamber 2B in which the paper material is crushed and the second rotating blade 32 and the second stationary blade 22 face each other; a first paper material supply passage 2C for supplying the paper material from the outside of the crushing chamber 2 into the first crushing chamber 2A; a second paper material supply passage 2D for supplying the paper material from the outside of the crushing chamber 2 into the second crushing chamber 2B; a communicating chamber 2E wherein the paper material crushed at the first crushing chamber 2A and the second crushing chamber 2B is gathered; and a discharge port 2F for discharging the paper material in the communicating chamber to the outside of the crushing chamber 2. Incidentally, numeral 20 designates a packing, and the packing 20 seals inside the crushing chamber 2.

An end surface 5C of the one side 5A of the driving shaft 5 is located in the first paper material supply passage 2C, and a portion 2C' of the first paper material supply passage 2C facing the end surface 5C of the driving shaft 5 is narrowly formed adjacent to the end surface 5C. Also, on the end surface 5C of the driving shaft 5, projections or scraping blades 50 are attached for preventing the paper material flowing from the first paper material supply passage 2C from entering into the space between the portion 2C' and the end surface 5C.

Figure 9:
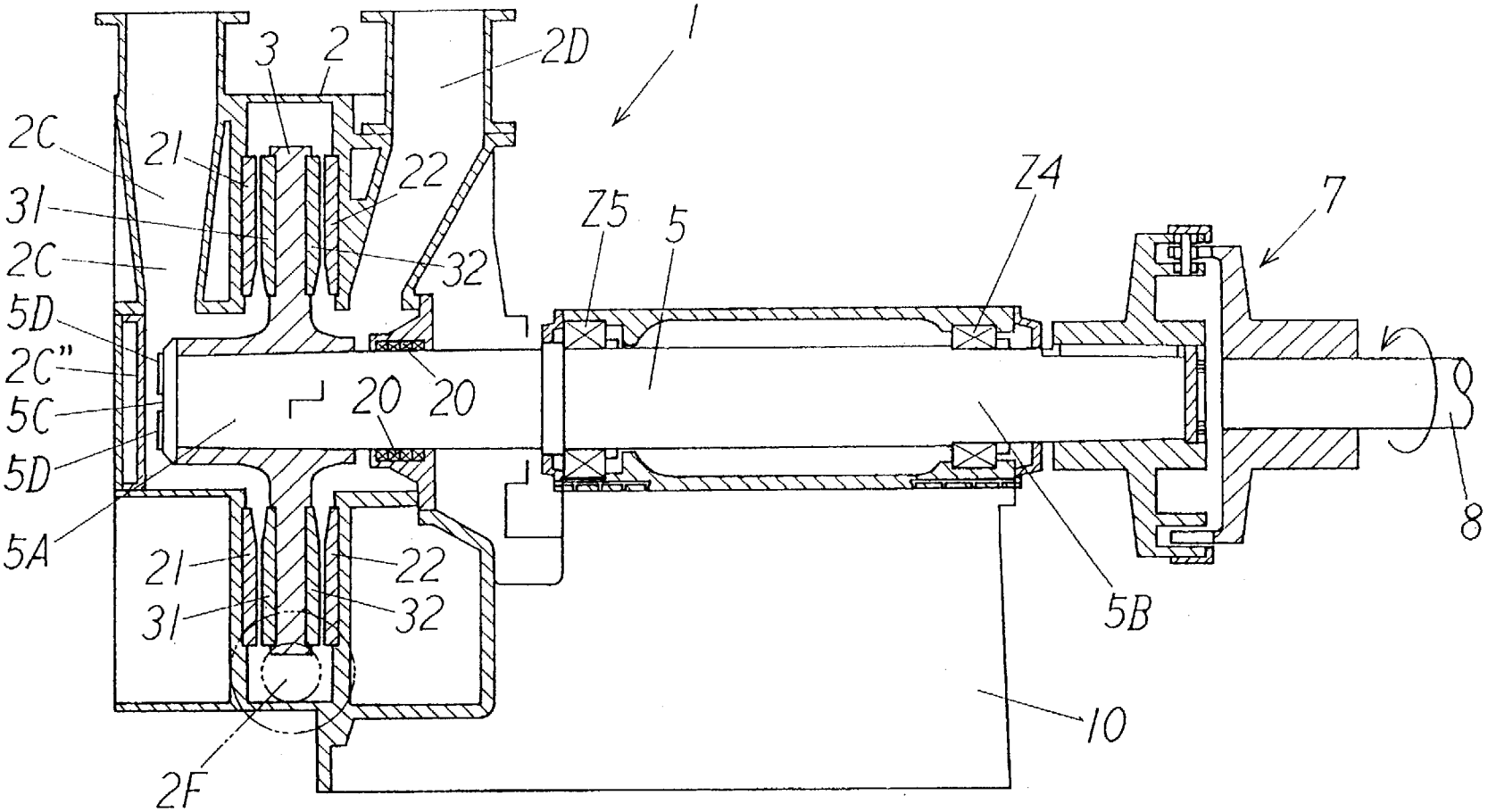
FIG. 9 is a schematic sectional view for showing another embodiment of the double-disc refiner shown in FIG. 1.

Incidentally, the portion 2C' of the paper material supply passage 2C facing the end surface 5C of the driving shaft 5 can be formed narrowly by that, for example, as shown in FIG. 1, the portion of the paper material supply passage 2C protrudes toward the projections. On the other hand, as shown in FIG. 9, the projections 5D may be provided adjacent to the portion 2C" of the paper material passage 2C facing the end surface 5C without touching the portion 2".

Although the portion 2C' of the paper material supply passage 2C is fixed in the embodiment of FIG. 1, the portion 2C' can be provided movably to adjust a distance between the end surface 5C and the portion 2C' facing the end surface 5C in accordance with a kind of the paper material solution, rotational speed of the driving shaft 5 or the like. The portion 2C' may be moved inside the paper material supply passage 2C by a shaft fixed to the portion 2C' and passing through a casing for the chamber 2.

Accordingly, in use, the paper material solution or pulp suspension as a paper material flows through the first paper material supply passage 2C into the first crushing chamber 2A, and also flows through the second paper material supply passage 2D into the second crushing chamber 2B, and the pulp suspension is crushed respectively between the first rotating blade 31 and the first stationary blade 21, and between the second rotating blade 32 and the second stationary blade 22.

At this time, even if the end surface 5C of the driving shaft 5 is located in the first paper material supply passage 2C, in accordance with the rotation of the driving shaft 5, the projections 5D prevent the paper material flowing through the paper material supply passage 2C from entering into the space between the end surface 5C of the driving shaft 5 and the portion 2C'. Therefore, a pressure applied to the end surface 5C of the driving shaft 5 is reduced to minimize the influence thereof. Thus, the driving shaft 5 is activated by the pressures applied to both surfaces of the rotating disc 3 to equalize a space between the first rotating blade 31 and the first stationary blade 21., and a space between the second rotating blade 32 and the secondary stationary blade 22.

Figure 5:
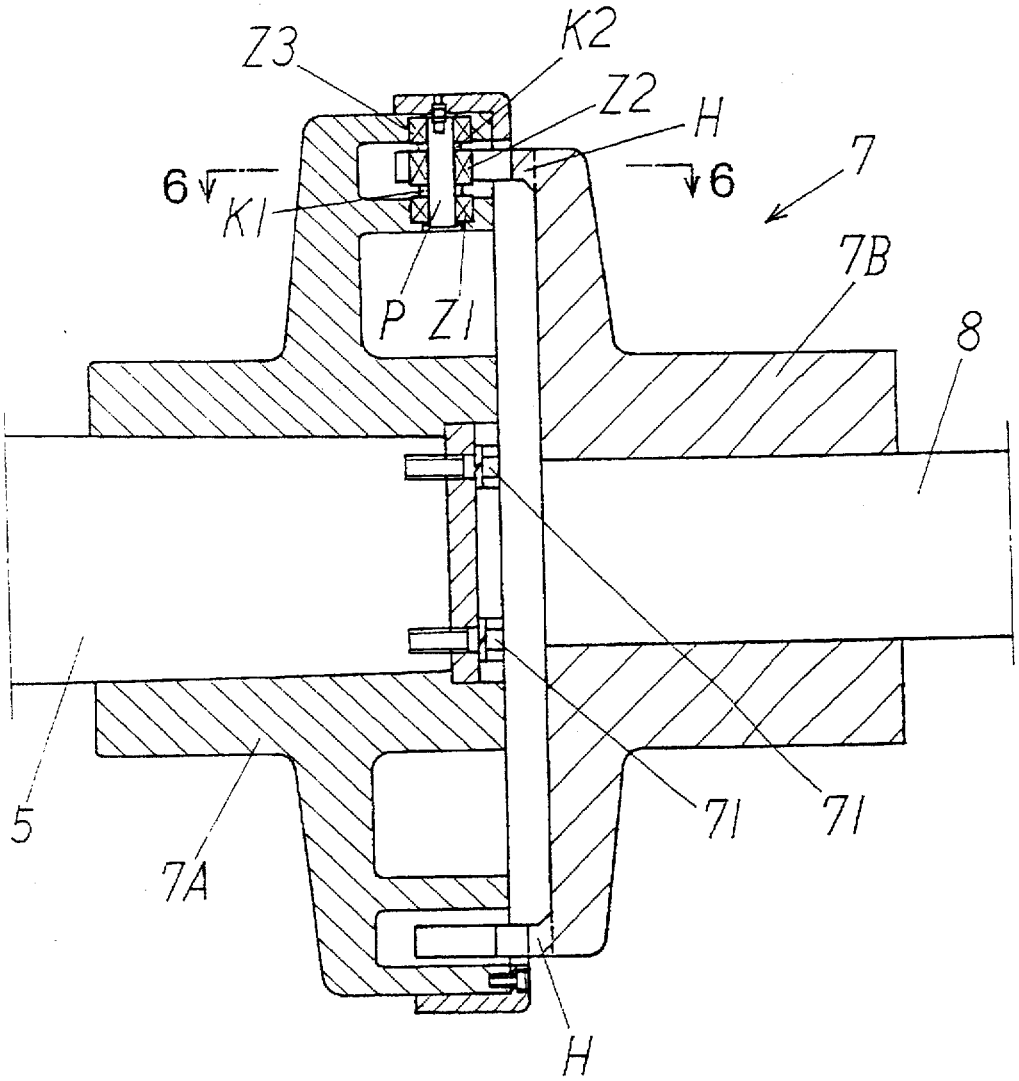
FIG. 5 is a schematic enlarged sectional view for showing a coupling part shown in FIG. 1.
Figure 6:
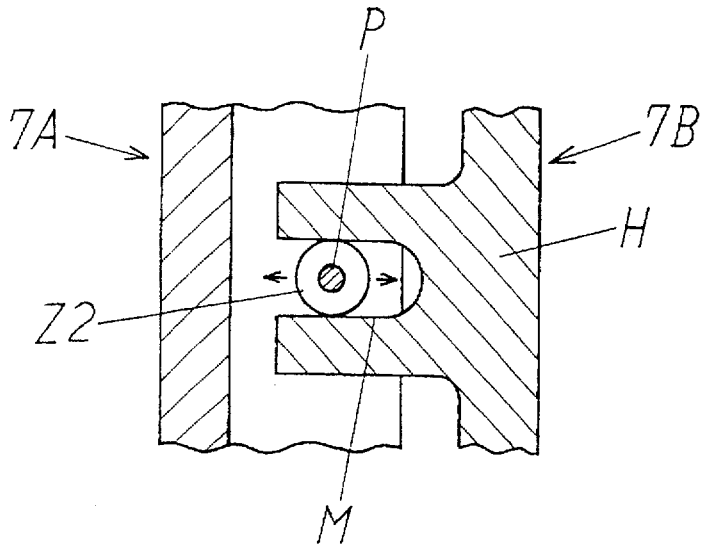
FIG. 6 is a schematic sectional view taken along line 6—6 in FIG. 5.
Figure 7:
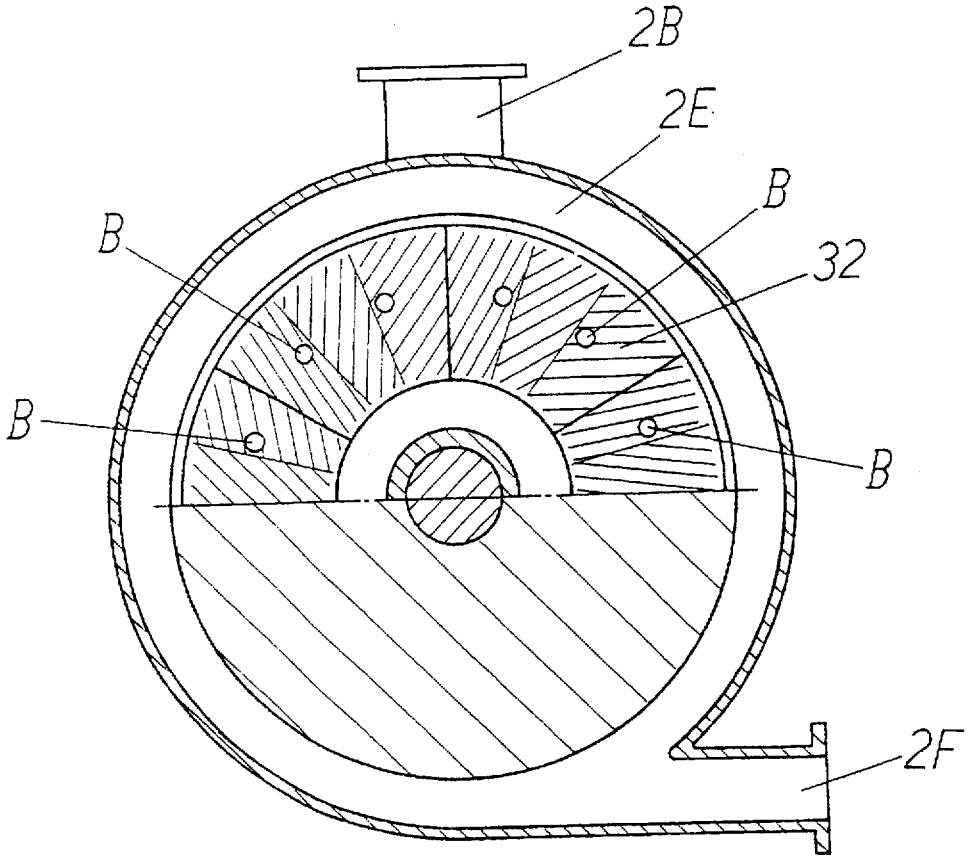
FIG. 7 is a schematic sectional view taken along line 7—7 in FIG. 1.
Figure 8:
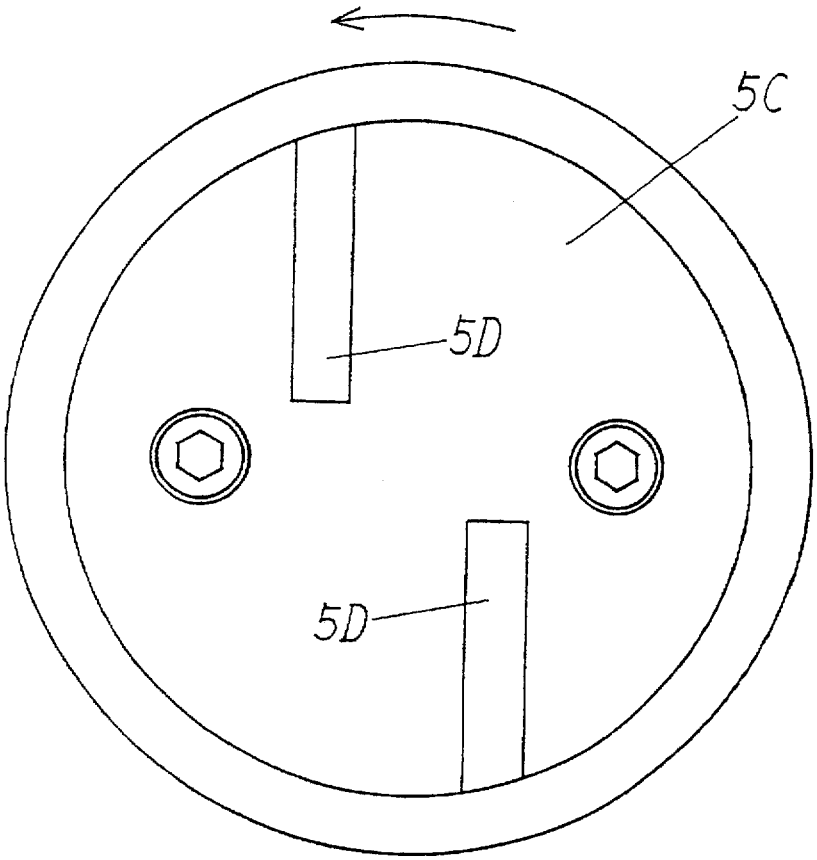
FIG. 8 is a schematic side view of an end surface of one end of the driving shaft.

Also, the other side 5B of the driving shaft 5 is connected to a motor (not shown), through a coupling 7. The driving shaft 5 is rotatable by the motor through the coupling 7 and is movable in the shaft direction (referring to FIGS. 5 and 6).

Namely, the coupling 7 is formed of a coupling 7A, as one side, connected to the other side 5B of the driving shaft 5 by a bolt 71, and a coupling 7B, as the other side, connected to a rotating shaft 8 of the motor (not shown).

In the coupling 7A, bearings Z1, Z2 and Z3 are attached by a pin P. A collar K1 is disposed between the bearings Z1, Z2, and a collar K2 is disposed between the bearings Z2, Z3 to keep the distances between these members. Also, a standing wall H of the coupling 7B is provided with a recess M in which an outer race of the bearing Z2 moves.

As a result, in case there is a difference between the pressures applied to both surfaces of the rotating disc 3 in the crushing chamber 2, the outer race of the bearing Z2 moves along the recess M. Thus, the driving shaft 5 can move in the shaft direction.

Incidentally, a casing 9 disposed on a central part of the driving shaft 5 moves together with the driving shaft 5 in the shaft direction, but is not rotatable.

Figure 4:
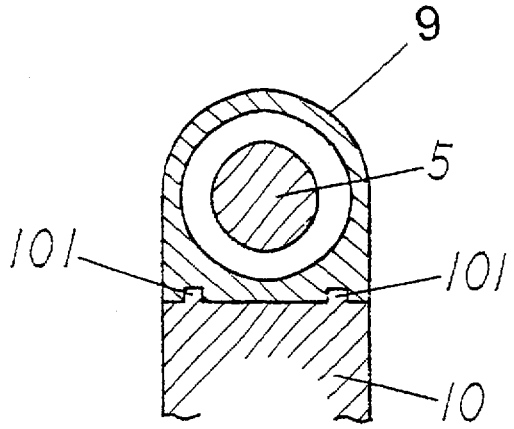
FIG. 4 is a schematic sectional view taken along line 4—4 in FIG. 1.

Namely, the other side 5B of the driving shaft 5 is supported by bearings Z4, Z5 disposed in the casing 9. Then, an inner race ZU of the bearing Z5 is fixed to the driving shaft 5 by a step portion 51 and an attachment member 52 which are disposed on the driving shaft 5, and an outer race ZO of the bearing Z5 is fixed to the casing 9 by an attachment member 91. Furthermore, rollers R are disposed between the inner race ZU and the outer race ZO, and as shown in FIG. 4, the casing 9 is structured to slide on rails 101 disposed on a base 10. As a result, the casing 9 does not rotate, but only the driving shaft 5 rotates, and in accordance with movement of the driving shaft 5 in the shaft direction, the casing 9 moves.

According to the first aspect of the invention, the portion of the first paper material supply passage which faces the end surface of the one side of the driving shaft is formed narrowly relative to the end surface, and the end surface is provided with projections for preventing the paper material flowing through the first paper material supply passage from entering into a space between the portion and the projections. Therefore, even if the end surface of the one side of the driving shaft is located in the first paper material supply passage, in accordance with the rotation of the driving shaft, the projections prevent the paper material flowing through the first paper material supply passage from entering into the space between the end surface of the driving shaft and the portion of the first paper material supply passage. Accordingly, a pressure applied to the end surface of the driving shaft can be decreased to reduce the effect thereof, and the driving shaft is moved or shifted laterally by the pressure applied to the both surfaces of the rotating disc. As a result, the spaces between the rotating and stationary blades are equalized to equally crush the paper material.

Also, according to the second aspect of the invention, since the projections are provided close to, without touching, the portion of the first paper material supply passage, even if the end surface of the driving shaft is located in the first paper material supply passage, in accordance with the rotation of the driving shaft, the projections prevent the paper material flowing through the paper material supply passage from entering into the space for the end surface of the driving shaft. Therefore, the same effects as in the first aspect can be obtained.

While the invention has been explained with reference to the specific embodiments of the invention, the explanation is illustrative and the invention is limited only by the appended claims.

What is claimed is:

1. A double-disc refiner for crushing a material, comprising:

a driving shaft having a free end with an end surface on one side, and a supported end on the other side thereof, said driving shaft being movable in an axial direction of the shaft, a rotating disc disposed on the driving shaft near, free end and having a first rotating blade on one side thereof and a second rotating blade on the other side thereof, a crushing chamber disposed around the rotating disc and having a first stationary blade disposed on an inner wall thereof to face the first rotating blade and a second stationary blade on the inner wall of the crushing chamber to face the second rotating blade, said crushing chamber including a first crushing chamber formed between the first rotating blade and the first stationary blade, a second crushing chamber formed between the second rotating blade and the second stationary blade, and a communicating chamber communicating with the first and second crushing chambers, a first supply passage communicating with the first crushing chamber for supplying the material to the first crushing chamber and having a side wall facing the end surface of the driving shaft, said first supply passage extending to the first crushing chamber through portions located radially outside the free end of the driving shaft, a second supply passage communicating with the second crushing chamber for supplying the material to the second crushing chamber, and projections formed on the end surface of the driving shaft and located in the first supply passage, said projections facing the side wall and being located adjacent thereto so that the projections formed on the end surface prevent the material supplied radially inwardly toward the driving shaft through the first supply passage from entering into a portion between the end surface and said side wall to thereby reduce a pressure applied to the end surface of the driving shaft by the material.

2. A double-disc refiner according to claim 1, further comprising a discharge port communicating with the communicating chamber for discharging the material crushed in the first and second crushing chambers.

3. A double-disc refiner according to claim 2, wherein said first and second supply passages are formed in the crushing chamber.

4. A double-disc refiner according to claim 2, further comprising a casing surrounding the driving shaft to permit the driving shaft to rotate therein, said casing moving together with the driving shaft in an axial direction of the driving shaft.

5. A double-disc refiner according to claim 4, further comprising a coupling attached to the driving shaft to permit axial movement of the driving shaft and to transfer rotational force from a motor to the driving shaft.

6. A double-disc refiner according to claim 1, wherein said side wall of the first supply passage projects toward the driving shaft so that a small space is formed between said side wall and said projections.

7. A double-disc refiner according to claim 1, wherein said side wall of the first supply passage is generally flat so that a small space is formed between said side wall and said projections.

8. A double-disc refiner according to claim 1, wherein said first supply passage includes a first section located in the crushing chamber near the side wall and extending in a radial direction of the driving shaft, and a second section communicating between the first section and the first crushing chamber and extending substantially radially outside the free end of the driving shaft.

* * * * *